United States Patent [19]

Reindel

[11] 4,419,635

[45] Dec. 6, 1983

[54] SLOTLINE REVERSE-PHASED HYBRID RING COUPLER

[75] Inventor: John Reindel, San Diego, Calif.

[73] Assignee: The United States of America as represented by the Secretary of the Navy, Washington, D.C.

[21] Appl. No.: 305,231

[22] Filed: Sep. 24, 1981

[51] Int. Cl.[3] ..... H01P 5/107; H01P 5/18; H01P 5/22

[52] U.S. Cl. ..... 333/116; 333/120; 333/26; 333/161; 333/246

[58] Field of Search ..... 333/115, 116, 120, 123, 333/161, 238, 246, 26

[56] References Cited

U.S. PATENT DOCUMENTS

| | | | |
|---|---|---|---|
| 3,995,239 | 11/1976 | Head et al. | 333/246 X |
| 4,023,123 | 5/1977 | Reindel | 333/238 X |
| 4,316,160 | 2/1982 | Dydyk | 333/161 X |

FOREIGN PATENT DOCUMENTS

| | | | |
|---|---|---|---|
| 2747871 | 5/1979 | Fed. Rep. of Germany | 333/161 |

OTHER PUBLICATIONS

Horton, *Crossovers In Microstrip*, Electronics Letters, Feb. 16, 1978, vol. 14, No. 4, pp. 110, 111.

*Primary Examiner*—Paul L. Gensler
*Attorney, Agent, or Firm*—Robert F. Beers; Ervin F. Johnston; Harvey Fendelman

[57] ABSTRACT

A slotline directional coupler is disclosed that introduces a 180° phase reversal in one of the arms of the coupler in order to isolate opposite ports of the coupler. One of the arms of the coupler is split and a quarter wave shorted slotline is added to each portion of the split coupler arm. The split coupler arm is bridged by a short conductive strap that, in a first embodiment, is grounded on both ends to the slotline ground plane or in a second embodiment, is extended to appear as though grounded. In the first embodiment, the conductive strap is separated from the ground plane by air. In the second embodiment the dielectric substrate of the coupler separates the strap from the ground plane. The conductive strap serves as a slotline-to-microstrip-to-slotline transition which introduces a 180° phase shift in a signal propagating through it.

11 Claims, 6 Drawing Figures

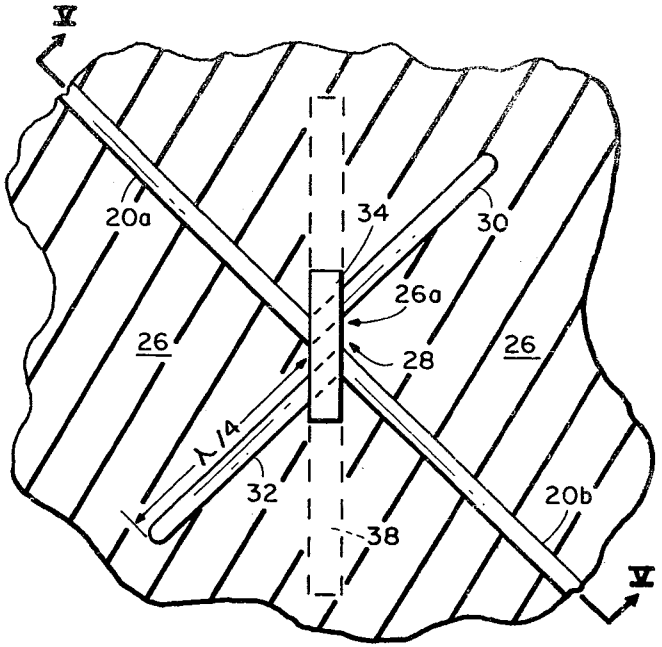
FIG. 1
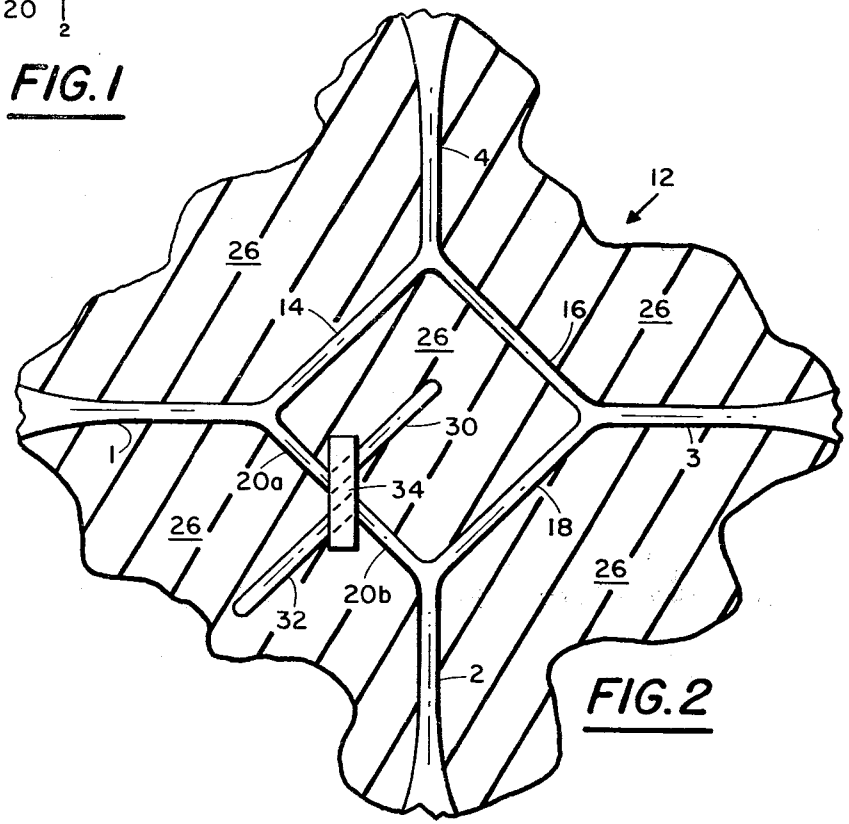
FIG. 2
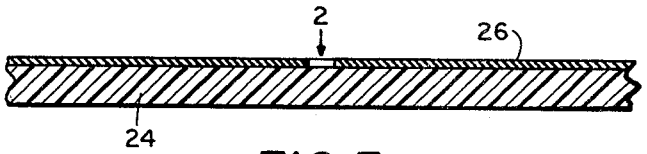
FIG. 3
FIG. 4

SLOTLINE REVERSE-PHASED HYBRID RING COUPLER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The hybrid ring circuit, the so-called rat race, has been used for many years and is still an essential part of many complex microwave circuits such as mixers, filters, phase shifters and power dividers. The rat race has three of the four transmission lines between ports equal to one-quarter wavelength and one line equal to three-quarter wavelengths at midband. The isolation between any two opposite ports is infinite at midband because the two lengths differ by exactly by 180° but drops rapidly with a change in frequency due to the change in relative path lengths. The useful bandwidth is about 10%. A modified ring circuit is described in "A Wide Band Hybrid Ring for UHF" by W. V. Tyminski, Proceedings of IRE, January 1953, p. 81–87 and is useful over more than an octave bandwidth. The modified hybrid ring described therein has four transmission lines between output ports each equal to one-quarter wavelength at midband and provides an even 3 db power split. The device, however, was originally used only in the low UHF band because it could not be fabricated for use at higher frequencies. A balanced-line hybrid for extending the operation into the microwave region was described by J. W. Carr in the Microwave Journal, May 1973, p. 49–52.

A microstrip hybrid directional coupler has been disclosed in which the 180° phase shift is brought about by a twisted pair of parallel conductors. See U.S. Pat. No.4,023,123 issued May 10, 1977 to John Reindel.

SUMMARY OF THE INVENTION

The present invention relates to a slotline directional coupler suitable for use in many complex microwave circuits such as mixers, power dividers, feed matrices and filters. The performance of the present invention is superior to all known prior art printed circuit couplers at frequencies above 30 GHz. The reverse phased coupler of the present invention may be used for any degree of coupling from about 3 db to 10 db. The device is extremely small, and is relatively easy to fabricate.

Basically, the device of the present invention functions as a hybrid directional coupler in the slotline medium by dividing a signal appearing at any input port equally between adjacent output ports and by isolating the port opposite the input port. This is accomplished by splitting one of the four arms of the coupler and by adding a quarter wave shorted line to each of the sections of the split arm. The sections of split arm are bridged by a short conductive strap that is preferably grounded on both sides to the slotline ground plane and is separated from ground by air. This conductive strap serves as a slotline-to-microstrip-to-slotline transition that acts to introduce a 180° phase shift in a signal propagating through it. In an alternative embodiment, the slotline-to-microstrip-to-slotline transition may be positioned on the underside of the dielectric substrate of the coupler and extended to a distance of one-quarter wavelength on either side of the separation between the sections of split coupler arm. This construction causes the conductive strap to appear as though it were grounded.

STATEMENT OF THE OBJECTS OF THE INVENTION

Accordingly, it is the primary object of the present invention to disclose a novel directional coupler.

It is a further object of the present invention to disclose a novel hybrid ring type coupler.

It is yet another object of the present invention to disclose a novel means for introducing a 180° phase reversal.

It is yet a further object of the present invention to disclose a novel hybrid ring coupler that is constructed primarily in the slotline medium.

Other objects, advantages and novel features of the invention will become apparent from the following detailed description of the invention when considered in conjunction with the accompanying drawings.

BRIEF DESCRIPTIONS OF THE DRAWINGS

FIG. 1 is a schematic representation of the reverse phased hybrid coupler of the present invention.

FIG. 2 is a top view of the ring coupler of the present invention.

FIG. 3 is a side view of a portion of the hybrid ring coupler of the present invention.

FIG. 4 is a detailed view of the 180° phase reversal circuit comprising two-quarter wave shorted slotlines and a microstrip strap and also illustrating in phantom lines an alternative embodiment of the present invention.

DESCRIPTION OF THE PREFERRED EMBODIMENT

Figure 6:
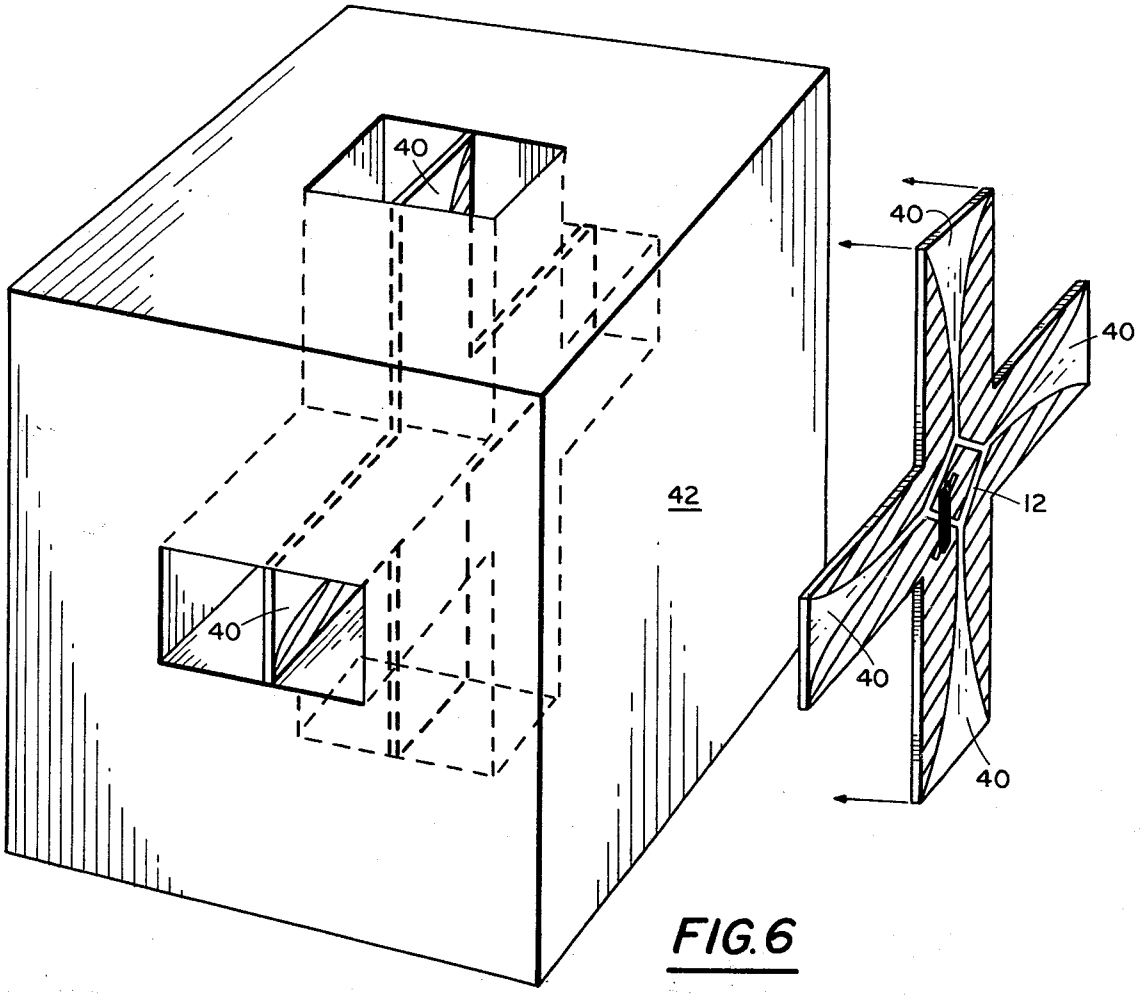
FIG. 6 is a perspective-exploded view of the coupler of the present invention enclosed within a waveguide housing.

Referring now to FIG. 1 there is illustrated a schematic diagram of the reverse phased ring coupler of the present invention. The reverse phase ring coupler 12 of the present invention has all four arms 14, 16, 18 and 20 equal to one-quarter wavelength at the midband operating frequency of the coupler. Arm 20 of the coupler includes a mechanism for introducing a 180° phase reversal in a signal propagating through that arm as is illustrated in FIG. 1 wherein the phase reversal segment is indicated by an X,22. Because the reverse phased ring is symmetrical, i.e. the two path lengths to the isolated port are exactly equal at all frequencies, the isolation is infinite at all frequencies and the power split does not vary. The device operates such that an input signal applied to input-output port 1 will be divided equally between input-output ports 2 and 4 and will be isolated from input-output port 3. Similarly, an input signal may be applied to any of the ports, 1, 2, 3 or 4 and it will be divided equally between adjacent ports and isolated from the opposite port. It is noted at this point that although the hybrid ring coupler 12 of the present invention has been illustrated in FIG. 1 as having a generally circular configuration, other shapes and configurations for the ring coupler are considered to be within scope of the present invention. Particularly, as will be described with respect to the embodiment of the present invention illustrated in FIG. 2, the coupler of the present invention may have a square configuration or any other configuration that results in an equal electrical length for the arms 14, 16, 18 and 20 of the coupler.

Referring now to FIGS. 2 and 3 the coupler 12 of the present invention is constructed on a dielectric substrate 24 on the surface of which is placed a layer of metal foil 26. The metal foil 26 is preferably copper that is applied to the dielectric substrate by any suitable technique. The dielectric substrate 24 is, for instance, a laminate or Teflon impregnated fiber board. The arms 14, 16, 18 and 20 are slotline transmission lines formed by etching away the metal layer 26, by photolithography or by any other suitable technique. Energy propagation in the slotline transmission arms 14, 16, 18 and 20 consists of electromagnetic fields in the slots formed between the areas of conductor 26. The input-output ports 1, 2, 3 and 4 are also illustrated in FIG. 2 as slotline transmission lines.

Figure 5:
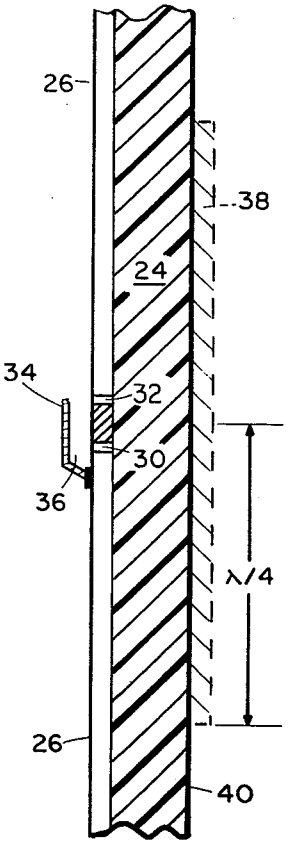
FIG. 5 is an end view taken along section lines V—V of FIG. 4 and also illustrating in dotted lines an alternative embodiment of the present invention.

Referring to FIGS. 2 and 4 it is seen that the arm 20 is split at area 28 such that there are two sections of the arm 20, namely, section 20*a* and section 20*b*. A first quarter wave shorted slotline 30 is connected to the inner end of the section of arm 20*a* and a second quarter wave shorted slotline 32 is connected to the inner end of the section of arm 20*b*. The quarter wave shorted slotlines 30 and 32 extend from the respective ends of arm sections 20*a* and 20*b* for a distance $\lambda/4$ where $\lambda$ is the wavelength at the midband operating frequency of the coupler. A short conductive strap 34 bridges the two-quarter wave shorted slotlines 30 and 32 and the strip of ground plane conductor 26*a* situated between the quarter wave shorted slotlines 30 and 32. It should be understood that the numerals 28 and 26*a* refer to the same region, the numeral 28 being used to indicate the region of separation between the section of arm 20*a* and the section of arm 20*b*, and the numeral 26*a* being used to indicate the presence of conductor 26 in the separation region 28. Referring to FIG. 5 it is seen that the strap 34 is grounded to the conductive foil 26 at the ends of the strap 34 and is separated from the slotlines 30 and 32 and the section of conductor 26*a* by an air gap 36. The conductor strap 34 in combination with the air gap 36 and the conductors 26 and 26*a* form or approximate a microstrip conductor. Further, the strap 34 serves as a slotline-to-microstrip transition from the slotline conductors 20*a* and 30. Likewise, the strap 34 serves as a slotline-to-microstrip transition from the slotline conductors 20*b* and 32. It should therefore be readily understood that the strap 34 serves as a slotline-to-microstrip-to-slotline transition between the slotline conductors 20*a* and 20*b*. Each slotline-to-microstrip transition creates a 90° phase shift in a signal propagating through it and, therefore, the strap 34, comprising two back-to-back such transitions, creates a 180° phase reversal in any signal propagating the arm 20 of the coupler 12 of the present invention.

Referring to FIG. 4 it is seen that the slotline 32 has a shape and position that is a mirror symmetry of the slotline 30. The two slotlines come in close proximity in the area of the separation 28 and it is also seen that the strap 34 is connected to the metal surface 26 by solder or conductive epoxy. The strap 34 is quite short (less than 0.01 inches) and can be assumed to have near zero phase length. The two back-to-back slotline-to-microstrip transitions formed by the strap 34 therefore introduce approximately a 180° phase shift and the total phase shift from port 1 to port 2 of the device 12 is 270°. Signals from port 1 arrive at port 3 via the two paths comprised of circuit arms 14, 16 and comprised of circuit arms 20, 18 and arrive at port 3 such that they 180° out of phase and are thereby canceled.

In FIG. 5 there is illustrated in dotted lines an alternative embodiment of the present invention. Particularly, instead of utilizing the conductive strap 34 on the metal foil 26 side of the dielectric substrate 24, a metallic strip 38 is applied to the opposite or underside 40 of the dielectric substrate 24. This conductor 38, illustrated also in phantom in FIG. 4, overlays the area of separation 28 of the stripline transmission sections 20*a* and 20*b*. The metallized region 38 serves as a microstrip conductor in combination with the dielectric substrate 24 and the metallized surface 26. The conductor 38 extends for a distance $\lambda/4$ on both sides of the separation 28 such that the conductor 38 appears to be shorted.

The slotline reverse phase coupler 12 of the present invention can be designed for any frequency by properly adjusting the length of the ring arms 14, 16, 18 and 20 to equal a quarter wavelength at the midband of the operating frequency of the device. The slotline medium of the present invention is particularly well adapted to the millimeter wave frequencies becuase the slotline medium is easily matched by simple transition to the conventional rectangular waveguide operating in the $TE_{10}$ mode as is illustrated in FIG. 6 wherein the coupler 12 is illustrated in combination with slotline-to-waveguide transitions 40 and is further illustrated in exploded form, as being enclosed within a waveguide housing 42. In comparison to microstrip, the waveguide enclosed slotline coupler 12 is less lossy and has a higher wavelength to line-width ratio. It is therefore will defined and suitable for use at higher frequencies.

Obviously, many other modifications and variations of the present invention are possible in the light of the above teachings. It is therefore to be understood that within the scope of the appended claims the invention may be practiced otherwise than as specifically described.

What is claimed is:

1. A microwave hybrid ring coupler comprising:

a dielectric substrate having first and second sides;

a metallized layer formed on the dielectric substrate first side;

first, second, third and fourth sections of slotline transmission medium formed in said metallized layer and interconnected so as to form a substantially enclosed area of metallized layer, the fourth slotline transmission medium having a separation formed therein and having a first slotline portion extending from one side of said separation and a second slotline portion extending from the other side of said separation;

a first shorted slotline extending from one end of said first portion;

a second shorted slotline extending from one end of said second portion; and a slotline-to-microstrip-to-slotline transition coupled to said first and second slotline portions.

2. The coupler of claim 1 wherein:

each of said first, second, third and fourth sections of slotline medium is approximately $\lambda/4$ in length where $\lambda$ is the wavelength at the midband operating frequency of said coupler.

3. The coupler of claims 1 or 2 wherein:

each of said first and second shorted slotlines is approximately $\lambda/4$ where $\lambda$ is the wavelength at the midband operating frequency of said coupler.

4. The coupler of claims 1 or 2 wherein said slotline-to-microstrip-to-slotline transition comprises a conductive strap extending over said separation and having first and second ends in contact with said metallized layer.

5. The coupler of claims 1 or 2 wherein said slotline-to-microstrip-to-slotline transition comprises a metallic strip positioned on said dielectric substrate second side.

6. The coupler of claim 1 wherein said slotline-to-microstrip-to-slotline transition has first and second ends and said first end extends for a distance of $\lambda/4$ from said first slotline portion and said second end extends for a distance of $\lambda/4$ from said second slotline portion where $\lambda$ is the wavelength at the midband operating frequency of said coupler.

7. The coupler of claim 4 wherein said first and second shorted slotlines extend from the area of said separation in opposite directions.

8. The coupler of claims 1 or 2 further comprising a waveguide housing enclosing said dielectric substrate.

9. The coupler of claim 3 further comprising a waveguide housing enclosing said dielectric substrate.

10. A microwave device for introducing a 180° phase shift in a microwave propagating signal comprising:

a first section of slotline transmission medium having an end;

a second section of slotline transmission medium having an end adjacent said first section end and separated from said first section by a ground plane conductor, said ground plane conductor also encompassing said first and second sections of slotline transmission media;

a first shorted slotline connected to said first section end;

a second shorted slotline connected to said second section end; and a conductive strap bridging said first and second shorted slotlines and grounded to said ground plane conductor.

11. The device of claim 10 wherein said first and second shorted slotlines are $\lambda/4$ long where $\lambda$ is the wavelength at the midband of said microwave propagating signal.

* * * * *